United States Patent [19]

Grelle et al.

[11] Patent Number: 4,614,157

[45] **Date of Patent: * Sep. 30, 1986**

[54] PLASTIC CARTRIDGE CASE

[75] Inventors: Peter F. Grelle, Edwardsville; Venkataramaraj S. Urs, Godfrey, both of Ill.

[73] Assignee: Olin Corporation, Stamford, Conn.

[ * ] Notice: The portion of the term of this patent subsequent to Feb. 11, 2003 has been disclaimed.

[21] Appl. No.: 657,445

[22] Filed: Oct. 4, 1984

Related U.S. Application Data

[63] Continuation-in-part of Ser. No. 510,529, Jul. 5, 1983, abandoned.

[51] Int. Cl.[4] ..... F42B 5/30

[52] U.S. Cl. ..... 102/466

[58] Field of Search ..... 102/464, 466, 467, 527

[56] References Cited

U.S. PATENT DOCUMENTS 2,953,990 9/1960 Miller ..... 102/467

4,147,107 3/1979 Ringdal ..... 102/467

*Primary Examiner*—Harold J. Tudor

*Attorney, Agent, or Firm*—Bruce E. Burdick

[57] ABSTRACT

An all-plastic cartridge case is disclosed. The case is all-plastic polyethylene and has a hard-plastic rim and a soft-plastic glass-filled high density polyethylene basewad. The basewad is of a plastic similar to but stronger and tougher than that of the shotshell tube while the rim is of a hard plastic which is chemically dissimilar to the tube. The rim is mechanically locked to the tough basewad and the basewad is chemically bonded to the tube. Also disclosed is a two-step method for molding such a shell with a triple plastic head. Either the rim or the basewad is molded first and the other of the two is molded through the first.

2 Claims, 6 Drawing Figures

PLASTIC CARTRIDGE CASE

BACKGROUND AND SUMMARY OF INVENTION

This is a continuation-in-part of our prior copending application Ser. No. 06/510,529, filed July 5, 1983, now abandoned.

This invention relates to non-metallic shotshells and more particularly to all plastic shotshells.

Conventional all-plastic shotshells all suffer from various problems. Most do not feed reliably from semi-automatic shotguns but instead suffer rim shear problems. Others experience tube shoot-offs or reloading problems. A solution to these problems is needed. A one-piece, hard plastic head may be molded using nylon, polycarbonate and similar resins on one end of an extruded polyethylene tubing to form an all-plastic cartridge case and the molded hard head would, prior to firing, adhere to the tubing and withstand (for example, in 12 gauge shells) 100 or more pounds of head pulling forces. However, when such hard-headed shotshells are fully loaded into shotshell rounds and are test fired in pressure barrels or guns, the heads become loose from the tubing and often fall off. It appears to applicants that, upon firing, the adhesion of the hard nylon and such other plastic heads to polyethylene tubing is insufficient to withstand firing forces as the two plastic materials are incompatible, being immiscible, and so do not form a strong enough initial chemical bond. Even the conventional pretreatment of the polyethylene tubing with chromic acid, chlorine or flame does not improve the adhesion of the hard head plastic to the polyethylene tubing upon firing. Thus, plastic shotshell manufacturers have uniformly only used head materials which are chemically similar to the plastic tube, thus sacrificing rim quality in order to have an adherent head to prevent gas leakage. Also, it has traditionally been felt by ammunition makers that hard plastic heads would be too brittle at low temperatures to withstand high firing pressures and would result in cracked heads, a critical defect.

The present invention solves the above problems by providing a three-part, all-plastic cartridge case without metallic reinforcement portions, comprising an exterior tubular body of polyethylene plastic having a base end; an internal adherent glass filled high density polyethylene plastic basewad molded to the inside surface of the base end of said body and having an axial opening adapted to receive a primer and having one or more interlock channels therein; an exterior hard, tough plastic rim molded into mechanically interlocked attachment to said interlock channels of said basewad, said rim being of a material chemically dissimilar from and not chemically adherent to either of said polyethylene tubular body and said polyethylene basewad.

The invention is best understood by referring to the attached drawing in which.

Figure 1:
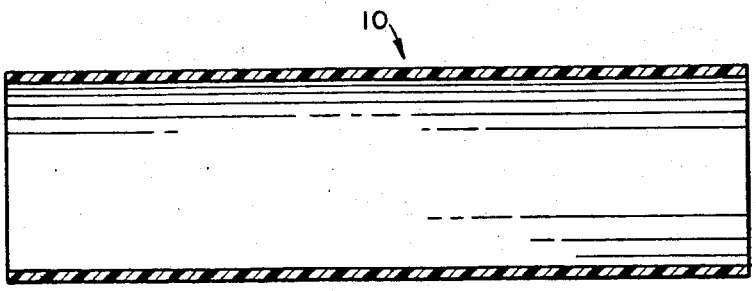
FIG. 1 is an axial central sectional view through a tube which can be used in the invention.
Figure 2:
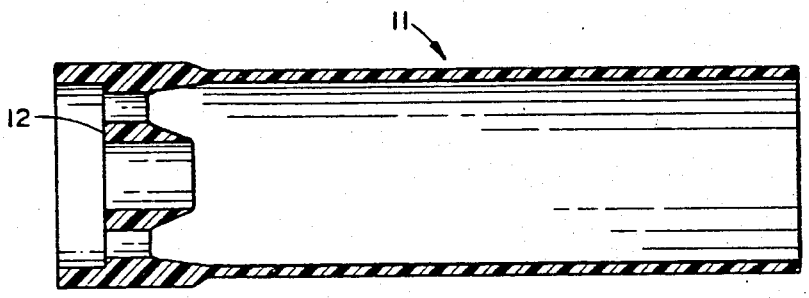
FIG. 2 is an axial central sectional view through a tube in which a basewad of the invention has been molded.
Figure 3:
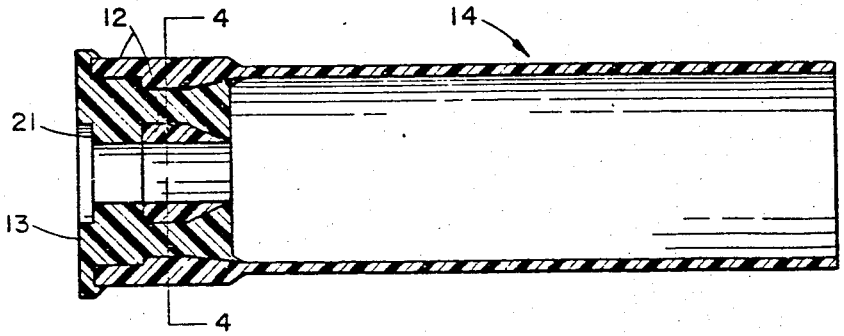
FIG. 3 is an axial central sectional view through a completed shotshell of the invention.
Figure 4:
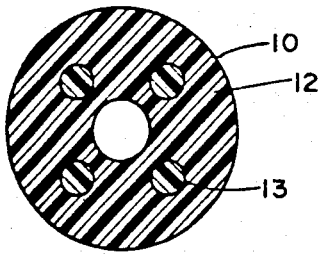
FIG. 4 is a diametrical sectional view taken along line 4—4 of FIG. 3.

Referring to FIGS. 1-3, an extruded polyethylene tube 10 (preferably a biaxially oriented tube of the Reifenhauser type) such as that shown in FIG. 1, of suitable length, diameter, and wall thickness is inserted into a mold. A perforated, glass-filled high density polyethylene ("GFHDPE") basewad core 12 is then injection molded to the interior of tube 10 to produce an unrimmed intermediate shotshell tube 11 as seen in FIG. 2. Next, a hard plastic rim body 13 is injection molded into and behind basewad core 12 to produce a hard-rimmed, all-plastic shotshell 14. As a preferred alternative, a hald plastic rim body 15 can be injection molded onto the base of tube 10 as seen in FIGS. 5-6 and then a GFHDPE basewad core 16 can be injection molded behind, through, and in front of rim 15 to mechanically lock rim 15 into place at the base of tube 10 to produce a hard-rimmed, all-plastic shotshell 17.

Figure 5:
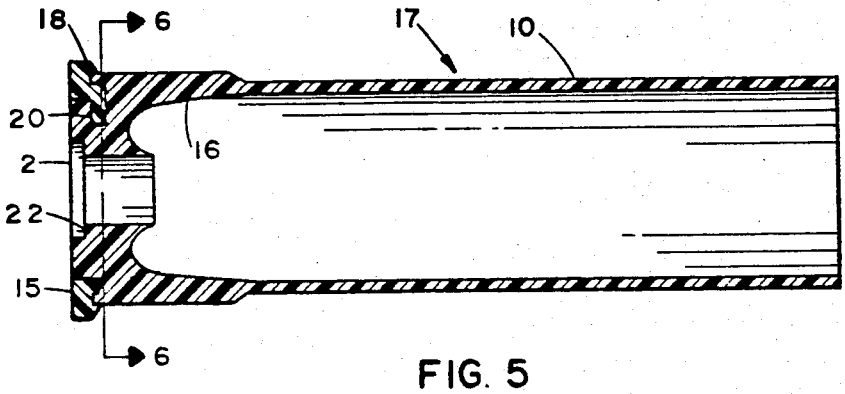
FIG. 5 is an axial central sectional view through a second form of completed shotshell of the invention.
Figure 6:
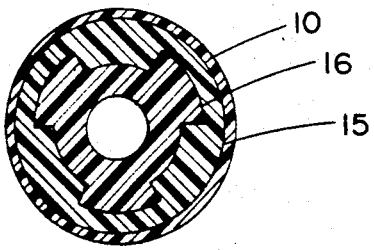
FIG. 6 is a diametrical sectional view taken along lines 6—6 of FIG. 5.

Referring to FIGS. 3 and 5, shotshells 14 and 17 comprise a sandwich construction with a GFHDPE (with or without fillers) core 12 or 16 and a hard nylon or polycarbonate rim 13 or 15 on the top and bottom axially of the GFHDPE core. This is achieved by a two-step molding. In one step, a thin head of the said GFHDPE is molded about 0.1" to 0.5" deep inside one end of the tube 10 with excellent bonding to the walls of tube 10 to form the centra layer of the proposed sandwich. Additionally, this GFHDPE head core is provided in the molding operation with a hold in the center for later seating of a primer (not shown). In the other step, a second hard and tough plastic, such a nylon, polycarbonate, polyethylene-terephthalate, butylene-terephthalate, or styrene-acrylonitrile copolymer or other similar hard and rough resins, is molded onto the bottom of tube 10. The molten second resin GFHDPE flows through the portion deposited in the first step. If the GFHDPE core 12 is molded first, the rim is injected below, through, and above core 12 to form a hard body mechanically locked to the polyethylene core 12. Alternatively, the hard rim 15 can be first injection molded onto the bottom end 18 of tube with a radial internal locking projection 20 being molded onto rim 15. A subsequently molded GFHDPE basewad core 16 then mechanically locks around projection 20, this minimizing and restraining axial movement and provides added support to any primer later seated inside the resulting shotshell 17. The core 16 is made of a glass-filled high density polyethylene (GFHDPE) plastic which is chemically similar to the polyethylene tube 10 so that core chemically bonds with the tube. The GFHDPE material must have a flexual modulus of 300,000 psi min, a mold shrinkage 0.008 in/in maximum and a glass content within the range of about 5% to 40% by weight. The hard, plastic rim 13 or 15 is thus mechanically permanently locked to the bottom of a core 12 or 16 by a strong but flexible crack-resistant basewad which is in turn strongly chemically bonded to tube 10.

It is preferred that the primer pocket 22 be partially lined with polyethylene or other relatively soft plastic so that gas leaks through the primer port and dropped primers are avoided and no cracks or splits are produced when the primer ignites, as might be the case if the hard rim plastic lined the primer hole. Also, there is no hard plastic at the top of basewad 16 so that cracking of the basewad top is reduced or eliminated. Unexpectedly, we have found this construction provides high strength, integrity, and adhesion of the dual plastic head to the polyethylene tubing. Nylons, in general, have served as the best second hard plastic. Polycarbonate (or its alloys with polyethylene or ABS) is the next best resin. Shotshell cartridge cases and centerfire cartridge cases such as Caliber .38 and Caliber .45 Auto have been made as per this invention and tested.

"Hard and tough plastic" as used herein with reference to rim plastic means a plastic material which can withstand the harsh magazine feeding forces of semi-automatic shotguns such as the Remington Model 1100 or Winchester Model 1400. In addition to the magnitude of the forces of such semi-automatic guns, there is the additional consideration that the feeding mechanisms were designed years ago on the premise that metal headed shells would be used. Applicants have found that these mechanisms, having been designed for metal rims, tend to slice through or ride over the rim if it is too soft or break or chip the rim if it is too brittle, thus jamming the gun. One conventional measure of hardness of plastics is the Shore D Hardness test according to ASTM Standard No. D2240: It has been found that a Shore D hardness of greater than about 70 at 70° F. (21° C.) is needed for consistent resistance to rim shearing or rim ride over (rim bending). A second hardness measure is the Rockwell hardness number according to ASTM Standard Test Method No. D-785. It has been found that a Rockwell hardness of greater than about R80 at 70° F. (21° C.) is sufficient to provide consistent resistance to rim shearing or rim bending.

Hardness alone is insufficient, as the plastic rim must not be so brittle that it cracks or shatters at cold temperatures, since a cracked head is generally considered to be a critical defect due to the probability of gas leaks through a cracked head. It has been found that the plastic rim will consistently resist cracking if it has an Izod Impact Strength of greater than 5 ft-lbs per inch of notch (270 Joules/meter of notch) at 0° F. (−18° C.) as based on ASTM Standard Test Method D256.

Another criteria of the plastic rim is that the plastic should provide the desired characteristics at minimum cost so that the advantages of the invention can be commercially realized. It would make little commercial sense to develop an all-plastic shotshell if it is more costly than a metal headed shotshell unless, of course, there were offsetting added benefits in performance. Nevertheless, this invention contemplates that new, better, cheaper plastics may arise. Some currently technically suitable materials such as the polyetherimide sold by General Electric under the trademark ULTEM, high-strength, reaction-injection-molded polyurethanes, polyphenylene sulfide and others, which are presently too expensive, could become economically feasible in the future.

The primary advantage of the present invention is its ability to function reliably in even the most unfavorable conditions in semi-automatic shotguns without rim shear, gas leakage, dropped primers, or other critical defects. Another significant advantage of the invention is its ability to be reliably reloaded and reused. The shotshell of the invention recognizes the need for shotshells to have materials of high shear strength at the rim and of high longitudinal and circumferential tensile strength in the tube and basewad while keeping the dissimilar materials locked together during both initial firing and refiring after reload. These dissimilar needs had, until the present invention, lead the major shotshell producers away from all-plastic shells. This invention constitutes the first all-plastic shotshell, by one of the three ammunition companies, which is equal in performance to the standard brass-headed factory loads of the major ammunition producers.

EXAMPLE

A Reifenhauser-type extruded polyethylene tube 10 of 0.780" outside diameter and 0.730" inside diameter is cut to 2.75" length (FIG. 1). This tube 10 is placed in a mold cavity, assembled in an injection molding machine, and high density polyethylene is injected into the inside of the tube 10 to form the core with several holes as shown in FIG. 2. This tubing with polyethylene core is moved to another mold cavity in a second injection molding machine and Nylon 66 is injected to form the rim 13 at the bottom and also for the nylon to flow through the holes in the polyethylene core and form a thin layer on the other side of the core 12 to lock the nylon section, and thus forming an all-plastic, hard-rimmed shotshell cartridge case 14 with a triple plastic head.

This case 14 is assembled with a shotshell primer (for example, Olin's 209-955 primer), loaded with a conventional powder charge of 23.5 grains of Olin's WC473 nitrocellulose propellant powder, a conventional plastic wad with $1\frac{1}{8}$ ounces of lead shot number $7\frac{1}{2}$ (diameter 0.095") and the mouth of the shotshell case is closed by conventional crimping. In accordance with conventional testing procedures, the loaded rounds are "conditioned" and fired in a pressure barrel at 0° F., 70° F., and +125° F. for pressure and velocity with the following results.

TABLE I

PRESSURE (PSI) AND VELOCITY (FPS)
10 ROUNDS FIRED AT EACH TEMPERATURE

| Temperature | Average Pressure (psi) | Average Velocity (fps) |
|---|---|---|
| 0 | 10,400 | 1196 |
| 70° F. | 9,900 | 1211 |
| 125° F. | 10,400 | 1231 |

After firing, the cartridge cases are examined and found to be intact. The plastic head retained its integrity.

When shotshell cartridges, with only Nylon 66 head (no polyethylene core) molded on Reifenhauser extruded tubing, are loaded as above and fired in the pressure barrel, the following results are obtained.

| Temperature | Average Pressure (psi) | Average Velocity (fps) |
|---|---|---|
| 0 | 8,600 | 1103 |
| 70° F. | 9,500 | 1175 |
| 125° F. | 9,800 | 1186 |

After firing, the cartridge cases are examined and we find that the nylon heads are loose from the tube and come off easily.

The shotshell cartridges 14 and 17 of this invention are fired for function and casualty in Winchester Super-X Model 1, Remington Model 1100 and Winchester 1400 at 0° F., 70° F., and 125° F. with good results. The shotshell cartridges are reloaded and fired five times in Remington Model 870 gun without any defects observed. The reloadability of the cartridges ten times is 96 to 97 percent. Under these reloading conditions, the triple hard plastic head stays on the tube and retains its integrity.

EXAMPLE 2

.410 gauge Reifenhauser extruded polyethylene tube is cut to 1.15" length and a dual plastic head of polyethylene and nylon is molded on one end of the tube. The cartridge case is loaded with Olin's 108 primer and fired in a pressure barrel to test the strength of the head. The head stays intact, retaining its integrity.

EXAMPLE 3

Another tube 10 of 0.780" outside diameter and 0.730" inside diameter is cut to 2.75" length as in FIG. 5. This tube 10 is placed in a mold cavity, assembled in an injection molding machine and a Nylon 66 base rim 15 is molded onto the bottom 18 of tube 10 and weakly adheres there to and forms the rim shape shown in FIG. 5 with internal locking projections 20. This tube with base rim is moved to another cavity in another injection molding machine and a GFHDPE (with 20% by weight glas fiber content) basewad 16 is molded below through and above the rim 15 and into strong chemical bonding with the inner wall of tube 10 and strongly mechanically locking around projections 20, thus forming an all-plastic, hard-rimmed shotshell. This case is loaded and fired as in Example 1 above, no internal or external defects are noticed. The rim is not sheared in the Winchester 1400 semi-automatic sporting shotguns, which from prior testing shear the rims of all presently commercially available all-plastic shotshells tested.

What is claimed is:

1. An all plastic cartridge case, comprising:

an exterior tubular cylindrical body of extruded biaxially oriented polyethylene plastic having a forward end and a base end;

an annular internal glass fiber filled high density polyethylene plastic basewad having a glass fiber content by weight with the range of from about 5% to about 40%, a flex modulus of at least 400,000 pounds per square inch and a mold shrinkage of no more than 0.006 inches per inch is permanently molded to the inside surface of the base end of said body and having an axial opening adapted to receive a primer and having one or more interlock channels extending axially therein;

an exterior plastic rim molded into mechanically permanently interlocked attachment to said interlock channels of said basewad, said rim being of a material which has an Izod impact strength at 0 degrees F. of at least 5 ft-lbs per inch of notch and a Shore D hardness number of at least 70 and which is chemically dissimilar from said tubular body and basewad, said rim having a base portion extending outwardly radially beyond the base of said tubular body, a reduced diameter neck portion extending axially through said interlock channel and a locking projection extending radially from said neck portion to lie axially forward of a portion of said basewad;

said basewad having a first portion disposed radially between said rim and said axial opening and having a second portion disposed radially between said rim and said base end of said tubular body.

2. The cartridge of claim 1 where the base end of said tubular body abuts the base portion of said rim.

* * * * *